United States Patent [19]

Kern et al.

[11] Patent Number: 5,038,866

[45] Date of Patent: Aug. 13, 1991

[54] POWDER DISCHARGE APPARATUS

[75] Inventors: Mark T. Kern, Goleta, Calif.; Richard C. Heath, Lewes; John Streater, Henfield, both of England

[73] Assignee: Santa Barbara Research Center, Goleta, Calif.

[21] Appl. No.: 574,553

[22] Filed: Aug. 27, 1990

Related U.S. Application Data

[63] Continuation of Ser. No. 331,087, Mar. 27, 1989, abandoned, which is a continuation of Ser. No. 933,499, Nov. 21, 1986, abandoned.

[51] Int. Cl.[5] ..... A62C 35/08; A62C 37/10; A62C 37/14; A62C 37/40

[52] U.S. Cl. ..... 169/28; 169/61; 169/58; 169/26

[58] Field of Search ..... 169/26, 28, 58, 77, 169/57, 19, 61, 62, 9

[56] References Cited

U.S. PATENT DOCUMENTS

| | | | |
|---|---|---|---|
| 483,522 | 10/1892 | Averell | 169/26 |
| 2,436,364 | 2/1948 | McDowell | 169/28 X |
| 2,712,881 | 7/1955 | Mathisen | 169/28 X |
| 2,720,270 | 10/1955 | Guise | 169/11 |
| 2,742,094 | 4/1956 | Mathisen | 169/28 |
| 2,766,832 | 10/1956 | Mathisen | 169/28 |
| 3,010,520 | 11/1961 | Seaberg | 169/77 |
| 3,265,248 | 8/1966 | Guest | 169/77 X |
| 3,333,641 | 8/1967 | Hansom et al. | 169/28 X |
| 3,552,495 | 1/1971 | Fiero | 169/28 |
| 3,604,511 | 9/1971 | Griffith et al. | 169/28 |
| 3,684,021 | 8/1972 | Poitras | 169/28 X |
| 3,762,479 | 10/1973 | Fike, Sr. et al. | 169/28 |
| 3,799,270 | 3/1974 | Boud | 169/28 |
| 3,884,307 | 5/1975 | Williams | 169/28 X |
| 3,965,988 | 6/1976 | Wesson et al. | 169/9 |
| 4,020,904 | 5/1977 | DePalma | 169/77 X |
| 4,159,744 | 7/1979 | Monte et al. | 169/26 |
| 4,328,867 | 5/1982 | Heath | 169/28 X |
| 4,394,868 | 7/1983 | McLelland | 169/58 X |
| 4,497,373 | 2/1985 | Farquhar | 169/61 X |
| 4,527,635 | 7/1985 | Kirchner | 169/26 |
| 4,637,472 | 1/1987 | Decima | 169/28 X |

FOREIGN PATENT DOCUMENTS

| | | | |
|---|---|---|---|
| 2076336 | 9/1971 | France . | |
| 1329788 | 8/1987 | U.S.S.R. | 169/77 |
| 2062457 | 5/1981 | United Kingdom . | |
| 8803824 | 6/1988 | World Int. Prop. O. | 169/61 |

*Primary Examiner*—Margaret A. Focarino
*Assistant Examiner*—James M. Kannofsky
*Attorney, Agent, or Firm*—W. C. Schubert; W. K. Denson-Low

[57] ABSTRACT

An apparatus for the discharge of powder by a fluidic propellant is suitable for use as a fire extinguisher, the apparatus including a container wherein powder and propellant is pressurized prior to use of the apparatus. Discharge of the powder and the propellant from the container is accomplished by means of a diaphragm in a wall of the container, there being a gas generator contained within a well of the container for providing an overpressure which, in combination with the pressure to which the propellant has been charged, fractures the diaphragm. Thereupon, the propellant and the powder exits the container in a homogeneous stream. The overpressure is less than approximately 30 percent, preferably 20 percent of the pressure to which the propellant and the powder are subjected during a charging of the container with the powder and the propellant. The charge pressure is in the range of 400-600 p.s.i. so as to be many times greater than the pressure of an environment external to the container. A battery operated circuit may be connected between a fire sensor and the gas generator for activation of the generator in a modular self-contained form of fire extinguisher.

6 Claims, 8 Drawing Sheets

POWDER DISCHARGE APPARATUS

This is a continuation of application Ser. No. 331,087, filed Mar. 27, 1989, now abandoned, which is a continuation of application Ser. No. 06/933,499, filed Nov. 21, 1986, now abandoned.

BACKGROUND OF THE INVENTION

This invention relates to apparatus for the rapid homogeneous discharge of fine powder for use in the extinguishing of fires as well as other situations requiring the rapid dispersion of fine powder. More particularly, the invention relates to powder discharge apparatus wherein the powder is contained under pressure in a chamber or bottle and mixed with a compressed propellant fluid such as an inert gas wherein the powder and the propellant fluid can be discharged rapidly upon a fracturing of a diaphragm of the chamber.

The discharge of powdered material is employed in a wide variety of situations ranging from the extinguishing of fires to the dispersement of agricultural material, such as insecticides, on farms. In the case of a hand-held fire extinguisher charged with a powdered fire suppressant, the powder is ejected in a steady stream under pressure by a gaseous propellant. However, there are situations in which all of the powder is to be discharged almost instantaneously, for example within a few milliseconds, such a situation arising in the extinguishing of fires in an aircraft.

A problem arises in the extinguishing of fires in an aircraft because of the need for a sudden discharge of the powdered fire-repellant material. Typically, fire-fighting equipment installed on aircraft must operate automatically in response to an explosive fire in order to be effective. The sensor, as is well known, operates via an electrical circuit to fire a detonator or squib to explosively eject powder from a container thereof throughout a region of the aircraft protected by the fire-fighting equipment.

The powdered fire-suppressant material operates most effectively when the material is dispersed as a fine powder throughout the region affected by the fire. However, in the prior art, the explosive force of the squib tends to compact the powder with the undesirable result of forming clumps of the material which hinder the effectiveness of the powder in extinguishing a fire.

A further consideration in the use of the foregoing fire-extinguishing equipment is the construction of the equipment as self-contained modules. In the past, a problem has arisen in that the electronic circuitry employed in automatic activation of the fire-extinguishing equipment on board aircraft has employed electrical power supplied by the aircraft, such power being applied typically at 28 volts. The use of the aircraft power has necessitated the installation of electrical cabling with the consequent inconvenience of incorporating all such wiring within instruction manuals employed in the manufacture and servicing of the aircraft. Such cabling is disadvantageous in combat situations wherein shrapnel produced by an explosion might possibly sever the cabling resulting in a disabling of the fire-extinguishing equipment.

SUMMARY OF THE INVENTION

The foregoing problem is overcome and other advantages are provided by apparatus for the discharge of powder, particularly for use in a fire-fighting application, wherein, in accordance with the invention, a powder and a pressurized propellant fluid are mixed together and held under pressure within a container such as a cylindrical or spherical bottle. One end of the bottle is provided with a diaphragm which is scored in a pattern of lines upon which the diaphragm fractures in the presence of over-pressure within the container. Advantage is taken of the fact that in the case of powdered material, there is a relatively large amount of space between particles of the powder, which space is available for storing of pressurized propellant fluid, particularly a propellant gas. By way of example in the use of a fire-fighting material such as aluminum oxide, the density of the powdered aluminum oxide is in the range of approximately 1/6 to ⅛ of the density of the solid compacted form of aluminum oxide. Therefore, in a bottle of aluminum-oxide powder, there is approximately seven times as much volume available for the propellant than is occupied by the powder.

The available space between the particles of the powder is used to store the fluid propellant. The theory of the invention applies primarily to a gaseous propellant such as nitrogen, argon, helium, etc., since a liquid propellant would have a wetting action on the powder, which would tend to generate a slurry of liquid and powder creating clumps. However, a slurry of liquid and powder may be useful if used with a gaseous propellant. The propellant is pressurized, the pressurization greatly increasing the amount of nitrogen which is held within the container. In the preferred embodiment of the invention, a gaseous propellant, such as nitrogen, is preferred because the gaseous propellant has a considerable amount of stored energy to aid in rapid discharge. Alternatively, a gas such as helium may also be used since helium leak detection is readily available to check for leaks in the container.

A feature of the invention which is particularly useful in the fighting of aircraft fires is provided by the pressurization of the container. It is readily appreciated that in the case of a container having a diaphragm which is to be fractured in response to a pressure differential between the internal container pressure and the pressure of the aircraft bay, a reduction in bay pressure might fracture the diaphragm. This would necessitate a strengthening of the diaphragm with a consequent need for increased detonator pressure with a resultant excessive compaction of the powder. In prior art devices, the pressure from the squib pushes against the powder, which pushes on the diaphragm to the rupture point—hence the compaction difficulty. However, in the case of the invention, the container is initially pressurized in the range of 400–600 p.s.i. (pounds per square inch). Such pressure is many times larger than the atmospheric pressure (at sea level) of approximately 15 p.s.i. Hence, a loss of bay pressure results in a relatively small percentage increase of the differential pressure across the diaphragm so that there is no danger of premature fracture of the diaphragm in the apparatus of the invention.

In the construction of the invention, the diaphragm is set to fracture at an overpressure of 100 p.s.i. Thus, in the event that the initial pressurization is at 500 p.s.i., the diaphragm is set to fracture at 600 p.s.i., the additional 100 p.s.i. being provided by the squib. During activation of the apparatus, the internal pressure of the container is increased by only 20 percent, which pressure increase is sufficiently small so as to avoid any clumping of the powder. In addition, the squib is oriented to push directly on the diaphragm to avoid compacting the powder. This could not be done in prior art because there would be nothing to propel the powder outward if the squib pushed only on the diaphragm. In this invention the 500 p.s.i. pressure is available to propel the powder outward. Thereby, the apparatus of the invention is able to discharge the powder rapidly, homogeneously, and without clumping. In addition, the shearing forces generated by the 500 p.s.i. pressure aids considerably in breaking up the small powder particles into a fine cloud, this being the most effective state for fire suppression.

In accordance with a further feature of the invention, the powder discharge apparatus is constructed as a self contained module including a battery as a source of electric power. Electrical circuitry which is suitable for activating the apparatus in an aircraft installation, such as the circuitry disclosed in U.S. Pat. No. 3,931,521 of R. J. Cinzori, is to be modified to be operative with the relatively low voltage of a battery, and is to be further modified by the inclusion of low-noise circuitry for more reliable operation of the sensors with the reduced electrical supply voltage. This enables the individual modules of the apparatus to be tested and replaced as necessary from time to time without the necessity for interconnection with the aircraft power source, and without a risk of any damage to power supply cabling during combat.

In the foregoing embodiment of the invention, the relatively small overpressure may result in a small amount of clumping, as the force of the overpressure attempts to drive the fire-suppressant powder out of the container through the reduced diameter region of the exit or discharge port. Additional embodiments of the invention, to be described hereinafter, enable the use of the explosive discharge of a detonator or gas generator to free the powder without the direction of the force of overpressure in the direction of the velocity of powder exiting via the exit port. These embodiments avoid clumping of powder and facilitate a uniform dispersion of the powder.

BRIEF DESCRIPTION OF THE DRAWING

The aforementioned aspects and other features of the invention are explained in the following description, taken in connection with the accompanying drawing wherein.

DETAILED DESCRIPTION

Figure 1:
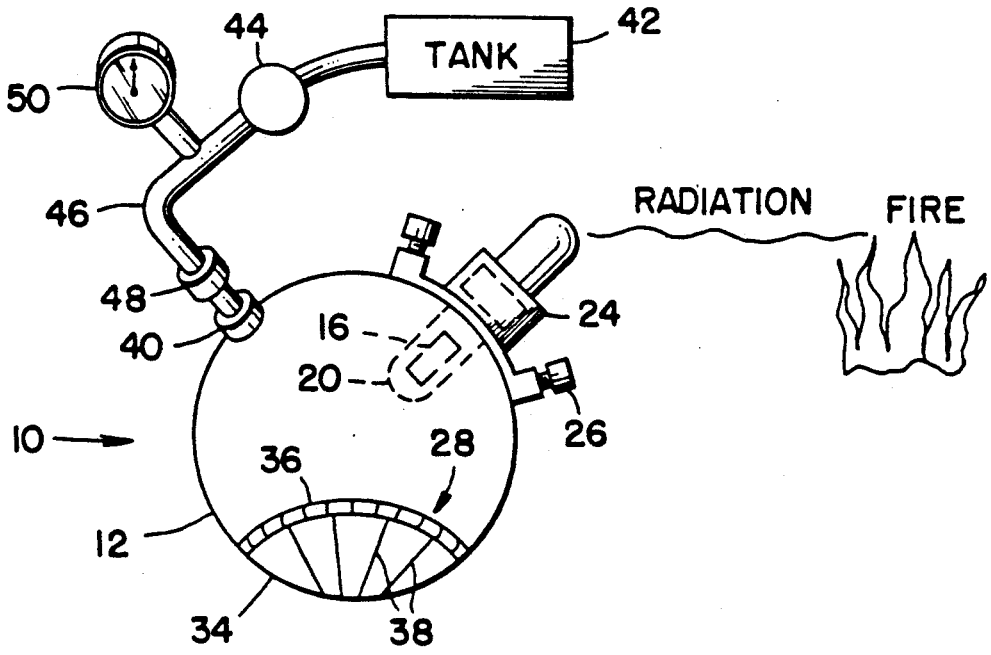
FIG. 1 shows a stylized view of a fire extinguisher constructed in accordance with the invention.
Figure 2:
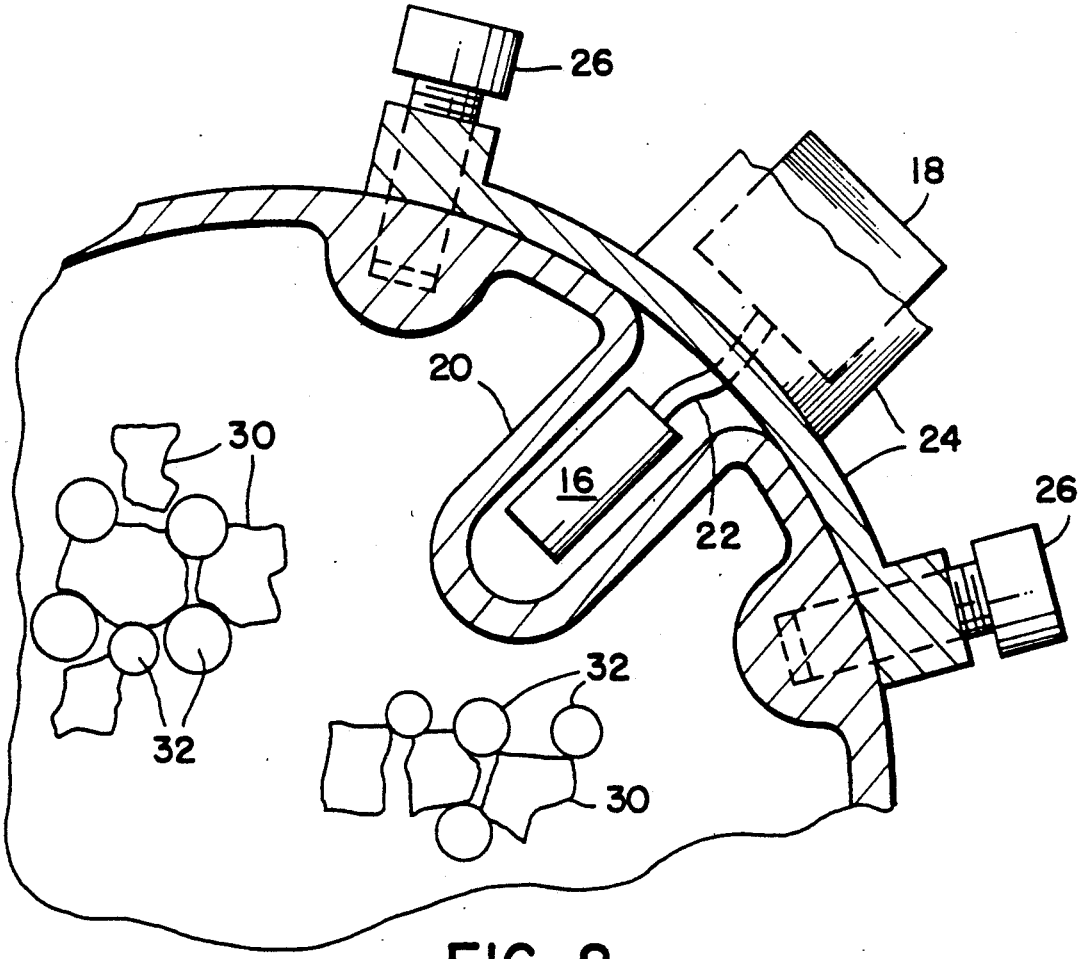
FIG. 2 is a fragmentary sectional view showing the emplacement of a detonator within a well of a bottle of the apparatus of FIG. 1.

With reference to FIGS. 1 and 2, there is shown apparatus for the homogeneous discharge of powder by a fluid propellant. The apparatus is ideally suited for use as a fire extinguisher and, accordingly, will be described as such. It is to be understood, however, that the apparatus is also suitable for providing a rapid homogeneous discharge of powder for applications other than fire fighting.

The apparatus is shown as a fire extinguisher 10 which comprises a container 12, an electro-optic sensor 14 of radiation emitted by fire, a gas generator 16, and a battery-powdered electronic circuit 18 which is responsive to the sensing of radiation by the sensor 14 for providing an electric signal suitable for activating the generator 16 to release gas under pressure. The generator 16 is located within a well 20 formed within a wall of the container 12, and extends inwardly to an interior region of the container 12. Electrical connection of the gas generator 16 to the circuit 18 is made by wires 22. The gas generator 16 is held within the well 20 by a housing 24 of the circuit 18, the housing being secured over the well 20 to secure the container 12 by a set of bolts 26. The bolts 26 have sufficient strength to overcome the force of the gas pressure of the gas generator 16, thereby to ensure that the well 20 fractures during such a pressure increase to direct the pressure to the interior of the container 12. Alternatively, the gas generator 16 may be secured within the well 20 by means of a plug (not shown) fitted by screw threads to the well.

A port 28 is provided within the wall of the container 12 to allow for the filling of the container with powder, and to allow for the subsequent discharge of the powder and propellant from the container 12. The powdered material is indicated by a stylized representation of powder particles 30. Propellant fluid, typically a gas such as nitrogen which is inert to a combustion process, is mixed with the particles 30 and is indicated in a stylized fashion by circles. Alternatively, a separate port (not shown) may be provided for filling the container, which port may be closed by a threaded plug.

Initially, the port 28 is open and the powder is loaded into the container 12 via the open port 28. The powder may be an inert substance such as aluminum-oxide, or it may be chemically active such as sodium bicarbonate or mono-ammonium phosphate. In order to completely fill the container with powder, the container 12 should be vibrated as the powder is being loaded so as to assure adequate settling of the powder and maximum filling of the container 12. The container 12, preferably, is completely filled with the powder. The particles 30 have a diameter in the range of approximately 1–3 microns. In the case of aluminum oxide, the density of the powder is approximately 0.5 grams per cubic centimeter, this being much lower than the density of solid aluminum oxide which has a value of approximately 3.5–3.9 grams per cubic centimeter. The interstitial spaces between the particles 30 provides adequate space for the molecules of the gaseous propellant.

Upon completion of the filling of the container 12 with the powder, the port 28 is sealed with a diaphragm 34 which is welded to the periphery of the port 28 as shown buy a weld bead 36. The weld ensures the integrity of the container 12 for maintaining propellant gas under pressure therein for extended periods of time. The diaphragm 34 is scored at score lines 38 so that, upon a fracturing of the diaphragm 34, the fractures occur along the score lines 38 in a pattern of fracture which ensures that no shrapnel is let loose from the diaphragm 34.

After securing the diaphragm 34 by the welding, the process of charging the container 12 with a desired amount of propellant is undertaken with the aid of a spring-loaded inlet gas valve 40 which allows the entry of propellant gas under pressure. As noted above, in the preferred embodiment of the invention, nitrogen is employed as the propellant. Accordingly, the nitrogen is provided by a tank 42, the nitrogen being pumped out of the tank 42 by a pump 44 which connects to the valve 40 by a high-pressure conduit 46 which may have the form of a flexible hose. A quick disconnect 48 is secured to the end of the conduit 46 to enable the conduit 46 to be disconnected from the valve 40 upon completion of the charging process. A gas pressure gauge 50 is also connected to an outlet of the pump 44 at the conduit 46 for monitoring the propellant pressure in the container 12 during the charging in the container with the propellant. Such charging may be done automatically or manually, in either case the charging terminating upon attainment of the desired pressure as measured by the gauge 50. Upon completion of the charging, the quick disconnect 48 is removed from the valve 40. The valve 40 functions in a well-known fashion to close itself in response to an internal spring (not shown) and in response to the pressure of the propellant within the container 12. The propellant pressure within the container 12, at the conclusion of the charging process, is in the range of approximately 400–600 p.s.i.

In the event that the powder was loaded into the container 12 in an atmosphere other than that of the propellant, the container 12 will need to be evacuated of atmospheric air before pressurizing. This can be done by connecting a vacuum pump in place of tank 42 prior to pressurizing. By thus drawing a vacuum, any atmospheric air that is present between powder particles 30 is drawn out by the vacuum pump leaving only the powder 30 in the container. Upon completion of the evacuation of the air, nitrogen can be pumped in as described.

The diaphragm 34 is designed to fracture at a pressure of approximately 100 p.s.i. above the charge pressure of the propellant. The container 12 and the diaphragm 34 is fabricated, preferably, of a metal such as stainless steel or aluminum. Thus, in the case of a propellant charge pressure of 500 p.s.i., the overpressure of 100 p.s.i. plus the charge pressure 500 p.s.i. results in a design fracture pressure of 600 p.s.i. for the diaphragm 34. In this case, the overpressure of 100 p.s.i. is 20 percent of the charge pressure of 500 p.s.i. Typically, the diaphragm should be designed for an overpressure of less than approximately 30 percent of the charge pressure. This ensures that the over pressure produced by the gas generator 16 is not so much larger than the charge pressure so as to introduce significant compaction of the powder with a resultant clumping of the powder.

The avoidance of the clumping of the powder is important to ensure retention of the fine size of the individual particles of the powder. This enables a homogeneous discharge of the powder as the powder is carried out by the propellant during a discharge of the fire extinguisher 10. In addition, the direction at which the gas from the gas generator 16 enters the container 12 from the well 20 is aimed to be directed more at the diaphragm than at the powder. As shown in FIG. 1 where the gas generator 16 and the diaphragm 34 are on opposite sides of the container 12, the gas outlet from the well 20 would flow toward the wall of the container 12 to create a swirling action inside the container 12 to avoid compacting the powder. The gas generator 16 and the well 20 could also be located just above the diaphragm 34 with equivalent results.

In operation, upon detection of radiation of a fire by the sensor 14, the electric circuit 18 activates the gas generator 16 to produce a sufficient overpressure within the container 12 to fracture the diaphragm 34. Thereupon, the propellant and the powder is forcefully and rapidly ejected from the container 12 to fill a space containing the fire. By way of example in a typical installation of the fire extinguisher 10, the extinguisher 10 would be located in a dry bay of an aircraft. Thus, discharge of the powder and the propellant within the dry bay greatly impedes the progress of the fire so as to extinguish the fire.

A particular factor in the utilization of the extinguisher 10, which factor provides for the advantageous homogeneous discharge, is the pressurizing of the container 12 with the propellant at a relatively slow rate, sufficiently slow, as compared to the actuation of the gas generator 16, to ensure that the molecules of the propellant gas percolate between the particles of the powder so as to provide a uniform mixture without compaction of the powder. During actuation of the gas generator 16, the pressure within the container 12 builds up at a far more rapid rate, than does the build up of pressure during the charging process. In particular, such rate of increase of pressure could readily compact the powder except for the fact that the maximum overpressure is only a relatively small fraction, in the range of 20–30 percent of the charge pressure. Thereby, essentially no compaction of the powder occurs during the detonation and the discharge. This mechanism is aided by the swirling action generated by providing an aim point of the gas generator to be off centered from a center of the container 12.

Figure 3:
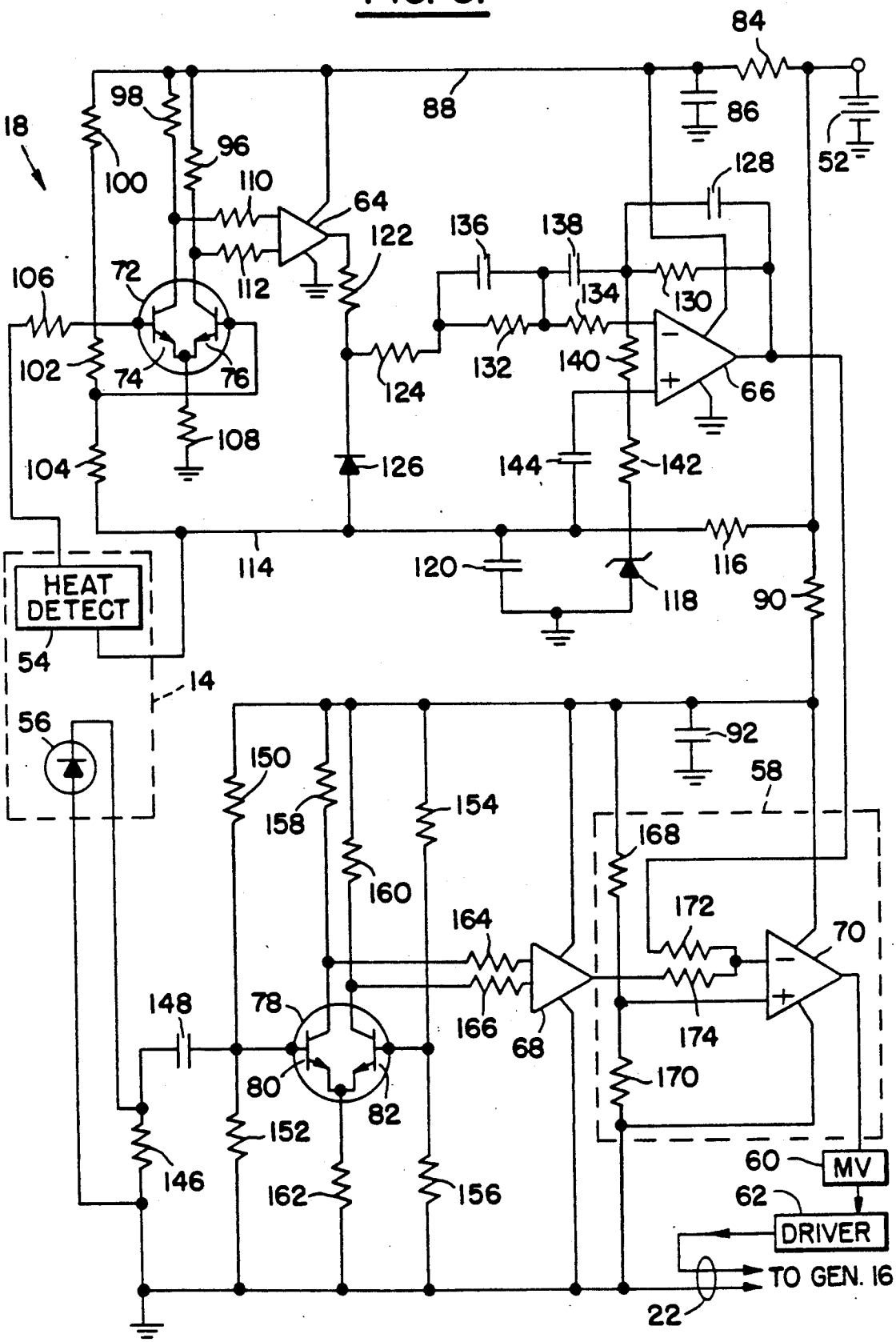
FIG. 3 is a schematic diagram of a battery operated electrical circuit suitable for activation of the fire extinguisher of FIG. 1.

FIG. 3 shows components of the circuit 18 of FIGS. 1 and 2, the circuit 18 being operative, in accordance with a feature of the invention, at a relatively low voltage of approximately 2 volts conveniently supplied by a battery 52 which permits modular construction of the fire extinguisher 10 without the need for electric power cables to a remote power source.

The circuitry of FIG. 3 is a modification of that disclosed in the aforementioned U.S. Pat. No. 3,931,521, the teachings of which are incorporated herein by reference. The radiation sensor disclosed therein comprises a short wavelength channel and a long wavelength channel. Accordingly, the sensor 14 (FIG. 1) is understood to comprise a heat detector 54, such as a thermopile or thermistor for the detection of the longer wavelength radiation, namely, heat, and a photodetector 56 such a photovoltaic diode for detection of photons of the shorter wavelength radiation.

The circuit 18 employs components which draw substantially less current than the circuit disclosed in the aforementioned patent so as to provide a long lifetime for the circuit without changing the battery. Preferably, the battery 52 is a lithium battery generating 2.4 volts and having a capacity of 2.3 ampere-hours. Signals outputted by the detectors 54 and 56 are amplified and applied to input terminals of a NOR gate 58, the latter outputting a command signal via a multivibrator 60 and a driver 62 to activate the gas generator 16 via the wires 22. The NOR gate 58 provides the logic function of activating the generator 16 when both heat and light radiation of a fire are detected. The multivibrator 60 is preset to generate an electrical pulse of sufficient duration for operating the generator 16, and the driver 62 amplifies the power of the pulse to a sufficient level for activating the generator 16.

The foregoing amplification of the signals of the detectors 54 and 56 is accomplished by operational amplifiers operating on the low voltage of the battery 52 and drawing very little current so as to allow the battery 52 to be employed for a period of 3–4 years. Such amplifiers 64 and 66, are shown in FIG. 3, the amplifiers 64 and 66 serving to amplify the signal of the heat detector 54, and amplifier transistors 80, 82 serving to amplify the signal of the photodetector 56. Included in NOR gate 58 is a threshold such that signals from amplifier 66 and transistors 82 must decrease from their respective bias points (1.2 V above ground for a 2.4 V battery operation) by this threshold amount before the NOR gate recognizes the input signal as a logic "0". The amplifiers 64 and 66 are constructed preferably as operational amplifiers. A suitable amplifier for the amplifiers 64 and 66 is that manufactured by Precision Monolithics, part No. OP-22, which amplifier draws 10 microamperes with suitable choice of input resistors (not shown) on lines 172 and 174.

It is advantageous to connect the amplifier 64 to the heat detector 54 via a preamplifier 72 having the characteristics of low noise and low current. A suitable preamplifier is commercially available and manufactured by Intersil with part No. IT-139, which preamplifier draws 10 microamperes when biased properly via resistor 108. The preamplifier 72 comprises two transistors 74 and 76 having their emitter terminals connected together to form a differential amplifier configuration.

Power for the amplifiers 64 and 66, and the preamplifier 72 is coupled from the battery 52 via a filter comprising a resistor 84 and a capacitor 86, the output voltage of the filter appearing on line 88. Power from the battery 52 for the amplifier 80 and 82, and the NOR gate 58 is provided by a filter comprising resistor 90 and capacitor 92, output voltage of the filter appearing on line 94. The resistor 84 is connected in series between the battery 52 and the line 88, the capacitor 86 being coupled between the line 88 and ground. Similarly, the resistor 90 is coupled between a terminal of the battery 52 and the line 94, the capacitor 92 being connected between the line 94 and ground. The capacitors 86 and 92 provide paths for signal flow between the power lines and ground, the respective filters isolating signals of the two detectors 54 and 56 and inhibiting the pick up of noise from external sources and crosstalk between the two circuits.

The circuit 18 further comprises resistors 96, 98, 104, 106, and 108 which are associated with the operation of the preamplifier 72. The resistor 106 connects a terminal of the heat detector 54 to a base terminal of the transistor 74. The resistor 104 matches the combination of resistor 106 and detector 54 for offset nulling due to bias current. Similarly, a junction of the resistors 102 and 104 connects with a base terminal of the transistor 76 to provide a feedback path from the transistor 76 to amplifier 64. The resistor 108 is connected between ground and the junction of the two emitter terminals of the transistor 74 and 76 to provide for a differential bias control. The resistors 98 and 96 are connected as load resistors between the line 88 and the col lectors of the transistors 74 and 76, respectively. Output signals of the preamplifier 72 are provided at the collector terminals of the transistor 74 and 76, and are coupled via resistors 110 and 112 to input terminals of the amplifier 64.

A reference voltage is provided on line 114 by a reference voltage circuit comprising a resistor 116, and a bandgap reference 118 which are serially connected between the terminal of the battery 52 and ground. A capacitor 120 is connected in parallel with the reference 118. The reference voltage for line 114 appears across the reference 118. The reference 118 provides a reference voltage of 1.2 volts, a suitable diode being manufactured by National Semiconductor under part No. LM185, which diode draws 10 microamperes when biased appropriately via resistor 116. The feedback path of resistor 104 connects to the reference voltage line 114. The reference voltage line 114 also connects to a terminal of the heat detector 54. Typical values for resistors coupled to the preamplifier 72 are as follows, the resistors 96 and 98 each having a value of 120,000 ohms, the resistors 110 and 112 each having a value of 200 Kohm, and the resistor 108 having a value of 80 Kohm.

Output signals of the amplifier 64 are obtained via two serially connected resistors 122 and 124 with the aid of a diode 126 connected between the line 114 and the junction of the resistors 122 and 124. The resistor 122 and the diode 126 form a negative voltage clamp on the output signal of the amplifier 64 to avoid false triggering of the generator 16 by background radiation incident upon the detector 54.

The amplifier 66 has a feedback path comprising a capacitor 128 and a resistor 130 connected in parallel therewith between the output terminal of the amplifier 66 and a negative input terminal thereof. A series combination of resistors 132 and 134, each of which has a capacitor connected in parallel therewith, namely capacitors 136 and 138 respectively, is connected between the resistor 124 and the negative input terminal of the amplifier 66. A further series connection of resistors 140 and 142 connects between the negative input terminal of the amplifier 66 and the line 114, a junction of the resistors 140 and 142 being connected to a positive input terminal of the amplifier 66. A capacitor 144 is connected in parallel with the resistor 142. The capacitors 136, 138, and 144, in combination with their corresponding resistors 132, 134, and 142 provide for a high-pass filter function, while the feedback capacitor 128 in combination with the feedback resistor 136 provide for a low-pass filter function. The combination of the two filter function provides a desired bandpass characteristic to the amplifier 66 for identifying the spectral components of pulsations in thermal radiation which identifies the presence of a fire.

The diode 56 is operated in the photoconductive mode for converting photon energy of optical radiation from the fire into electric current, which current flows through the resistor 146. Incremental changes in voltage drop across the resistor 146 are coupled via capacitor 148 to a base terminal of the transistor 80. The transistor 80 and an output NPN transistor 82 are cascaded as shown to provide the necessary amplification for the photodiode signal, which, when amplified, is coupled via line 122 to the other input of the NOR gate 58. The transistors 80 and 82 are connected to the necessary and conventional bias, feedback and current limiting resistors 162, 152, 154, 150, and 160 for biasing these transistors to nonconduction in the absence of an input signal from the diode 56. The resistor 146 is adjustable in order to vary the overall sensitivity of this detector 56. The gain of amplifier transistors 80 and 82 is controlled by the values of resistors 154 and 158. A DC supply voltage for the amplifier transistors 80, 82 is connected at terminal 94 to provide the necessary operating power for this amplifier stage, and a filter capacitor 156 is connected across resistor 160 for the purpose of decoupling the bias supply from the circuit. By appropriate choice of resistors 160, 150, 152, and 146, the amplifier transistors 80, 82 can be made to operate on less than 10 microamps from the battery 52.

Each of the amplifiers 66 and 82 provides a negative-going voltage in response to signals outputted by their respective detectors 54 and 56, the joint occurrence of the two low-voltage output signals resulting on a triggering of the multivibrator 60 by the Nor gate 58. Relatively high values of voltage are outputted by the amplifier 66 and 68 in the absence of signals outputted by their respective detectors 54 and 56. Using commercially available parts, NOR gate 58 can be implemented using a 74HCOZ NOR gate with 74HC14 Schmitt triggers at the inputs to achieve the threshold effect and prevent oscillation for slowly changing inputs. (Two series Schmitt triggers will be needed since the 74 HC14 is an inverting gate.) If more precise control of the threshold is needed, an OP-22 amplifier can be used with low voltage germanium diodes connected from lines 172 and 174 to the negative input and a precise threshold with slight positive feedback set at the positive input. Thereby, the logic function represented by the NOR gate 58 can be accomplished with circuitry operative with the relatively low voltage of the battery 52 with minimal current drain.

If desired, it is also possible to connect additional circuitry (not shown) for testing the sensor 14. Such additional circuitry would include a switch for connecting an external source of power in lieu of the battery 52, and would also include light emitting diodes (LED's) for activating the two detectors 54 and 56 in a test mode. To prevent the output drive of driver 62 from activating the generator 16 during the test, an optical coupler such as that manufactured by Honeywell having part No. SPX7270 can be used to clamp the signal of the driver 62, without interference with normal operation of the circuit 18. A second such optical coupler can be used to couple the output drive signal to external test equipment for monitoring the result of the test.

Such testing can also include a test of the pressure in the container 12 by including a pressure gauge that transmits an electrical signal indicating the amount of pressure. Such signal can be temperature compensated by use of a resistive circuit employing a resistor having a resistance which varies with temperature. A suitable connector (not shown) can be mounted on the fire extinguisher 10 to facilitate electrical connection of the remote test equipment during the conduction of a test.

It is noted that the foregoing teachings for the circuit 18 and the test mode are also applicable for use with a fire extinguisher wherein the container holds a fire suppressant liquid, such as Halon, which liquid rapidly turns to a gas upon a fracturing of the diaphragm.

The foregoing description of the container of the fire suppressant powder and the mechanism for discharging the powder is capable of producing the desired result of powder discharge with reduced effect of clumping. However, some clumping may occur due to the fact that there is an overpressure due to the explosion of the squib, which overpressure acts within the powder for forcing the powder through the exit or discharge port. To overcome this situation, further embodiments of the invention are provided wherein the discharge of powder is obtained by use of a detonator or gas generator without the development of an overpressure which produces a force in the direction of the powder velocity during discharge. These latter embodiments of the invention avoid the tendency to clump the powder during discharge of the powder.

FIGS. 4–13 show sectional views, partially stylized, of additional embodiments of fire extinguishers incorporating the invention, these figures relating to the containment vessel for the powdered extinguishant and configurations of devices for opening a discharge port of the containment vessel for discharge of the powder. Electrical circuitry, suitable for activation of the discharge apparatus is the same as that which has been disclosed in FIG. 3. The basic physical structures of the extinguishers in the following alternative embodiments are similar to those already described with preference to FIGS. 1 and 2 so that only a simplified description of the embodiments of FIGS. 4–13 need be provided to explain the essential features thereof.

Figure 4A:
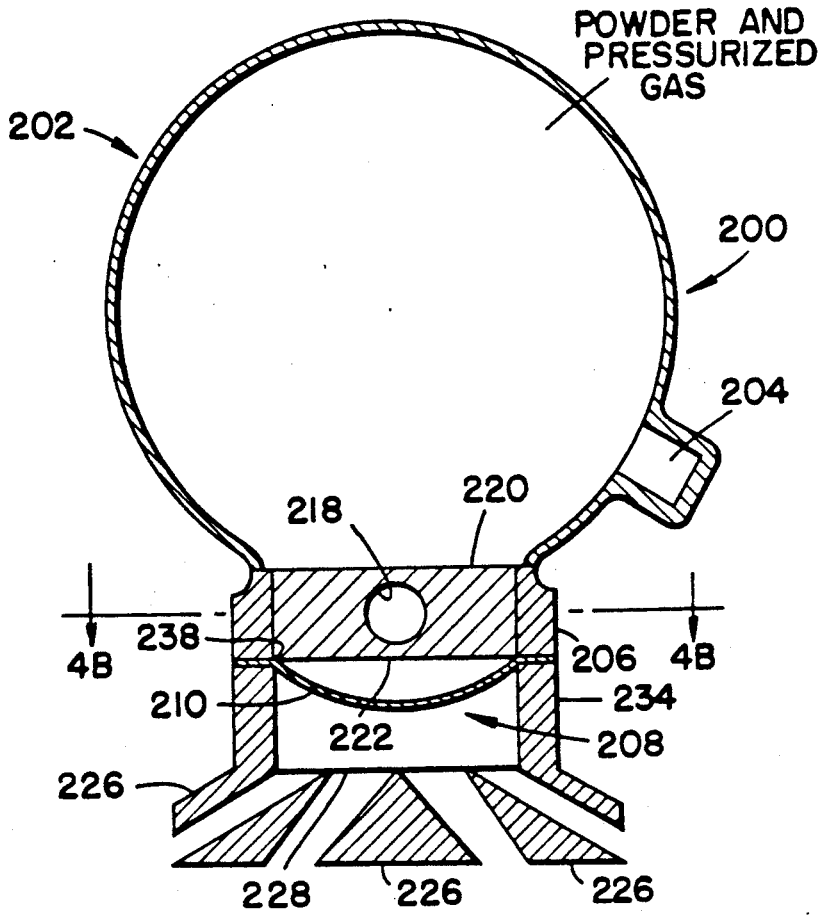
FIG. 4A shows a stylized sectional view of an alternative embodiment of the fire extinguisher wherein a detonator is placed in an exit port of a container of fire suppressant powder.
Figure 4B:
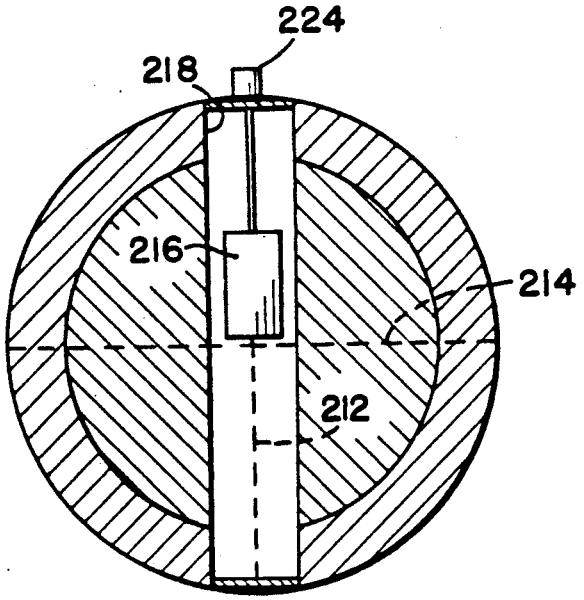
FIG. 4B is a sectional view taken along the line 4B—4B in FIG. 4A showing a scored disc and detonator in the exit port of FIG. 4A.

FIGS. 4A–4B show a fire extinguisher 200 including a vessel 202 for containing a fire-extinguishing powder and pressurized gas for expelling the powder from the vessel 202. The vessel 202 is filled with the powder and gas via a filling port 204 located in the side of the vessel 202. The vessel 202 terminates in a neck 206 which defines an discharge port 208 which is closed off by a disc 210 which is curved in the form of a spherical segment. The disc 210 is scored along two intersecting lines 212, 214 which facilitate fragmentation of the disc 210 for expulsion of the powder.

A rapid opening of the discharge port 208 for the extinguishing of a fire is attained with the aid of a detonator 216 disposed within a well 218 located in a supporting plug 220. The plug 220 is located in the neck 206 between the powder and the closure disc 210. The plug 220 may be scored on the underside at 222 facing the disc 210 to facilitate a fracturing of the plug 220 outwardly from the center of the vessel 202. The detonator 216 is activated by an electrical circuit such as that disclosed in FIGS. 1-3, the circuit being connected to the detonator 216 at a connector 224.

In operation, upon application of the electric signal via the connector 224 to the detonator 216, the detonator 216 explodes resulting in a fragmenting of the plug 220. The pressure of the gas in the vessel 202 is substantially greater than that of the outside environment, as was disclosed with reference to the fire extinguisher 10 of FIGS. 1-12. With the fracturing of the plug 220, the pressurized gas forces the fragments of the plug 220 towards the disc 210 and fractures the disc 210 to allow the gas and the powder to escape via the discharge port 208. Vanes 226, indicated diagrammatically, extend in a flared configuration from a rim 228 of the neck 206 to assist in a uniform dispersion of the fire-extinguishing powder. In this embodiment of the invention, it is noted that over pressure generated by detonation of the detonator 216 is exerted upon the powder in a direction away from the direction of exit velocity of the powder so as to avoid clumping of the powder during discharge of the powder from the extinguisher 200.

Further details of construction are the following. The vanes 226 may be angled at a flare angle of approximately 60 degrees from a central axis of the neck 206. The disc 210 may be secured at the periphery thereof within a circumferential slot 230 formed between an inner section 232 and an outer section 234 of the neck 206. The two neck sections 232 and 234 provide a pressure tight seal with the disc 210 so that the plug 220 need not provide a pressurized seal, the plug 220 serving simply to support the detonator 216 in its position relative to the powder and the disc 210.

Figure 5:
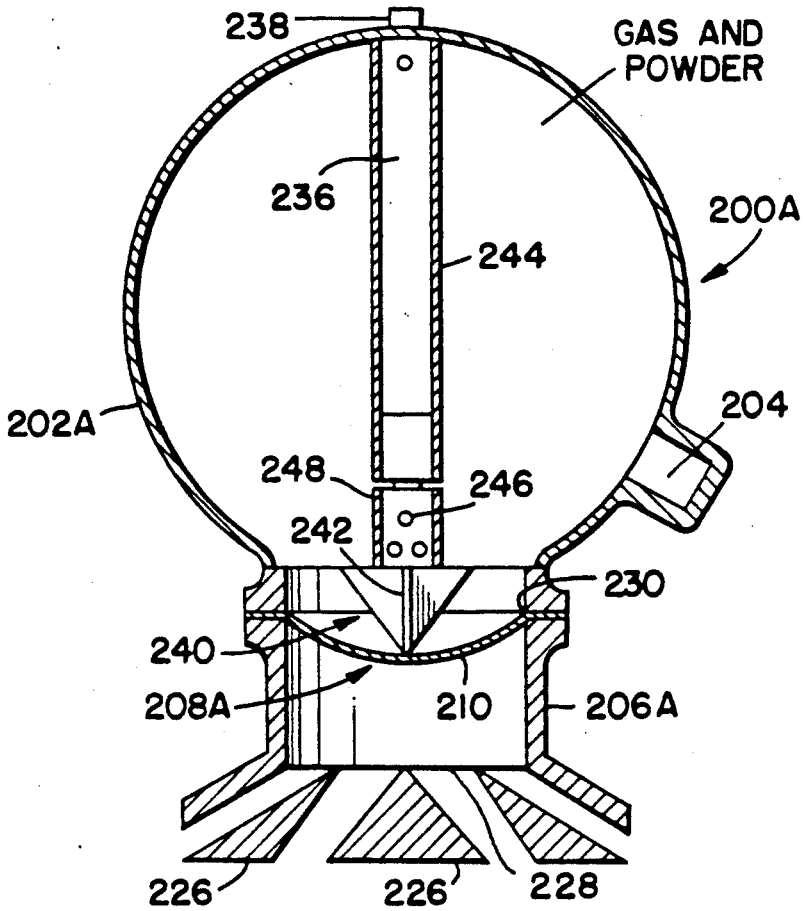
FIG. 5 is a view, similar to that of FIG. 4A, of a further embodiment employing a gas generator mounted within the container and positioned for driving a cutting blade towards a cover disc in the powder exit port.

A further embodiment of fire extinguisher 200A, shown in FIG. 5, includes components similar to that disclosed in FIGS. 4A-4B. The vessel 202 of FIG. 4A has been modified to provide the vessel 202A in FIG. 5 by the inclusion of a gas generator 236. The generator 236 has a generally cylindrical shape and is positioned along a central axis of the extinguisher 200A, and includes a connector 238 protruding through the top of the vessel 202A for receipt of an activation electrical signal from an activating circuit such as the aforementioned circuit 18. Gas and powder are held under pressure within the vessel 202A as disclosed in the previous embodiments of the invention. The vessel 202A terminates in a neck 206A which defines an exit port 208A for discharge of the gas and the powder. The closure disc 210 is secured within a circumferential slot 230 of the neck 206A in the same fashion as was disclosed in FIG. 4A for providing a pressure-tight seal for holding the gas and the powder within the vessel 202A.

A feature in the construction of the embodiment of FIG. 5 is the inclusion of a knife assembly 240 comprising four triangular knives 242 arranged symmetrically about the central axis of the extinguisher 200A and forming a common point directed towards the center of the disc 210. In both the embodiments of FIGS. 4A and 5, the concave surface of the disc 210 faces the center of the vessel 202A. This facilitates rupture of the disc 210 during discharge of the powder by the pressure of the gas and detonator in FIG. 4A, and by the pressure of the gas and an advancement of the knives 242 in FIG. 5.

In FIG. 5, the gas generator 236 is enclosed within a cylindrical wall 244 which also includes a piston 246 which forms a part of the knife assembly 240. The piston 246 is located within an end portion of the cylindrical wall 244. A pressure seal 248, in the form of a diaphragm is located within the cylindrical wall 244 to prevent leakage of the compressed gas within the vessel 202A past the knife assembly 240.

In operation, upon receipt of the electrical signal at the connector 238, the gas generator 236 rapidly produces gas under pressure which forces the piston 246 and the knives 242 downward to perforate the disc 210, thereby allowing the gas and powder to be discharged from the interior of the vessel 202A. The vanes 226 facilitate a uniform discharge pattern of the powder. The uniform dispersion of the powder is aided by placing some of the vanes 226 within a central portion of the discharge port 208, in addition to the mounting of individual ones of the vanes 226 on the rim 228 of the neck 206A. Support of vanes 226 within the central portion of the discharge port 208 can be accomplished in both the embodiments of FIG. 4A and FIG. 5 with the aid of rods (not shown) extending transversely across the necks 206, 206A, these rods having been deleted in FIGS. 4A and 5 for clarity.

In the embodiment of FIG. 5, the cylindrical wall 244 has sufficient strength to prevent rupture of the gas generator 236 into the vessel 202A, thereby to avoid the generation of a hydrostatic force which would act in the direction of the velocity of the escaping powder. Therefore, the construction of FIG. 5 wherein the gas generator 236 is contained within the cylindrical wall 244 prevents the clumping of the powder during discharge from the vessel 202A.

Figure 6:
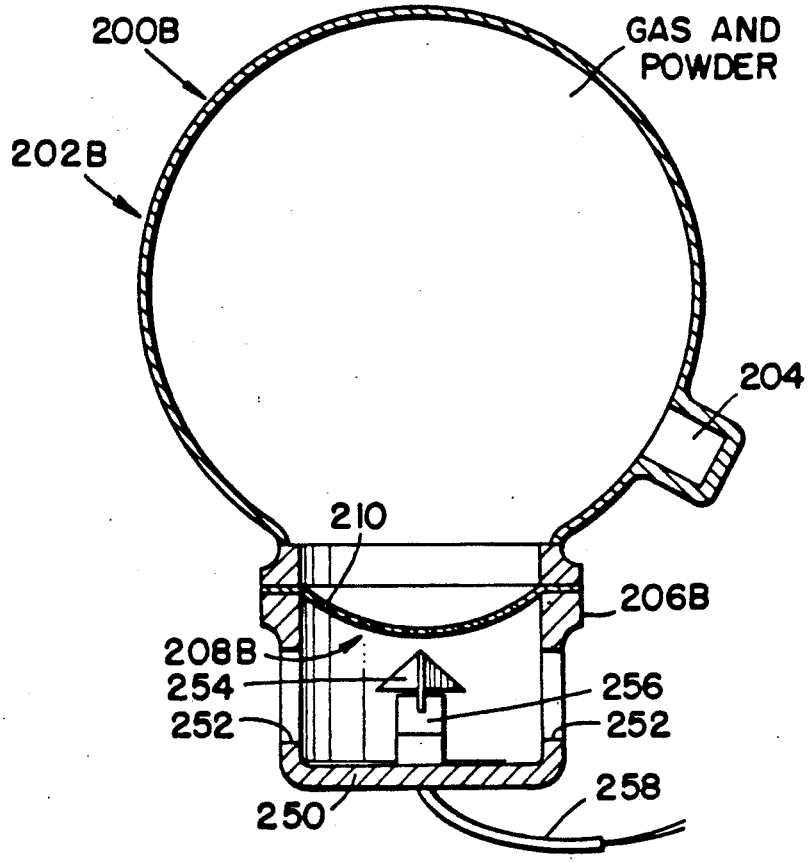
FIG. 6 is a view, similar to that of FIG. 4A, of yet another embodiment of the fire extinguisher wherein a knife and detonator are mounted externally of the container and facing a cover plate to fracture the cover for opening the exit port.

FIG. 6 shows a fire extinguisher 200B which shares features with the extinguisher shown in FIGS. 4A and 5, and also includes a neck 206B extending from a vessel 202B to form an exit port 208B for the discharge of gas and powder contained within the vessel 202B. The vessel 202B has the same general shape as the vessel 202 of FIG. 4A. The neck 206B is provided with a end wall 250 which extends perpendicularly to a central axis of the extinguisher 200B and includes a set of windows 252 positioned uniformly about a cylindrical wall of the neck 206B for directing a discharge of the extinguishant powder in a circular pattern about the longitudinal axis of the extinguisher 200B. Also included in the extinguisher 200B is a knife assembly 254, the knife assembly 254 extending from a protractor 256 upstanding from the end wall 250.

The knife assembly 254 has a four-knife configuration, as does the knife assembly 240 of FIG. 5, and points towards the concave surface of the disc 210. The disc 210 is secured in pressure-tight fashion to the neck 206B in the same fashion as was disclosed with reference to the necks 206A of FIG. 5. An electric signal provided from an activation circuit, such as the aforementioned circuit 18, is coupled via wires 258 for activating the protractor 256 to detonate with a consequent expulsion of the knife assembly 254 against the disc 210. Thereby, the knife assembly 254 fractures the disc 210 with the consequent release of the gas and powder from the vessel 202B. It is readily appreciated that none of the escaping gas produced by detonation of the protractor 256 develops a force which would introduce compaction to the extinguishant powder upon discharge of the powder from the vessel 202B.

Figure 7:
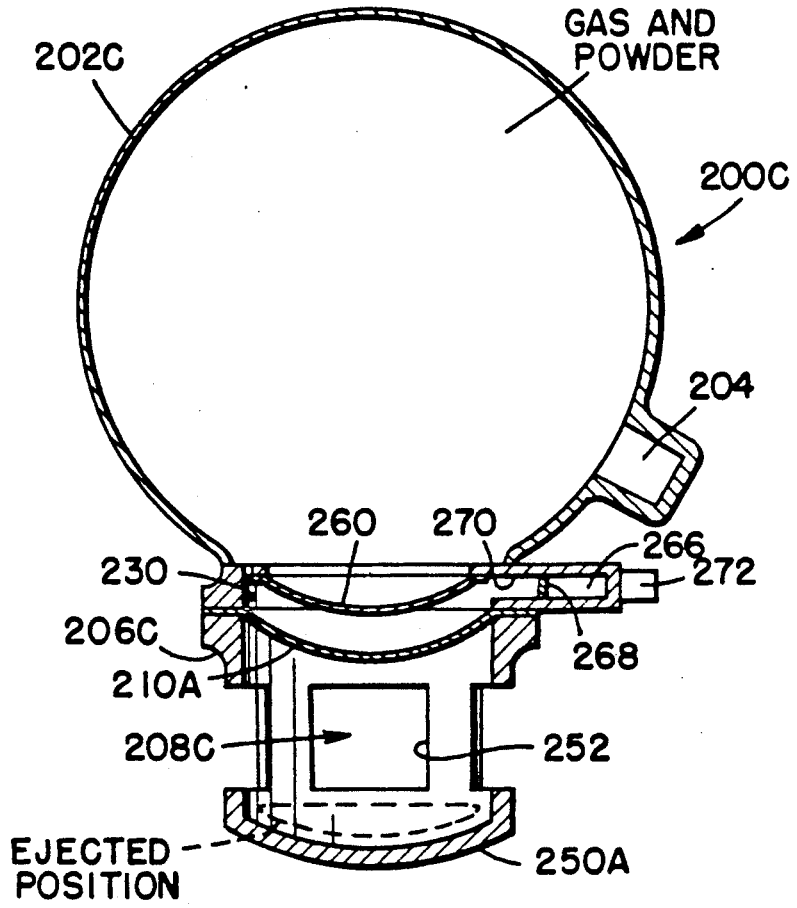
FIG. 7 illustrates another embodiment of the fire extinguisher employing a double disc covering of the exit port with a gas generator coupled to a space between the discs.

In FIG. 7, a fire extinguisher 200C is formed of a vessel 202C extending into a neck 206C which forms a port 208C for discharge of gas and powder contained within the vessel 202C. In a fashion similar to that disclosed in FIG. 6, the neck 206C includes a set of windows 252 which provide for a circular discharge of powder about a central axis of the extinguisher 200C. The neck 206C is provided with a end wall 250A which forces the powder to discharge sideways through the windows 252, and also serves as a nest for receipt of a disc 210A upon discharge of the powder. The disc 210A differs from the construction of the disc 210 in that a circular score line (not shown) is formed within the disc 210A at a line of contact with a slot 230 in the neck 206C.

The extinguisher 200C includes a further disc 260 secured to a base of the neck 206C between the disc 210A and the powder. A vent 262 is formed as a fine bore within a lip at the base of the neck 206C, the bore of the vent 262 being sufficiently small, typically less than one millimeter in diameter, to allow the pressure of gas contained within the vessel 200C to be equalized on both sides of the disc 260 during filling and pressurization of the vessel 202C. The diameter of the bore of the vent 262 is sufficiently small to provide a time constant of at least a few seconds for the pressure equalization. The disc 210A connects to the neck 206C with an airtight seal as has been described with reference to the disc 210 of FIG. 4A.

The neck 206C supports a housing 264 which extends radially outward from the base of the neck 206C and contains a gas generator 266 separated from the space between the discs 260 and 210A by a seal 268. A portion of the housing 264 is formed as a conduit 270 for guiding gas from the generator 266 to the space between the discs 260 and 210A during discharge of the extinguishant powder from the vessel 202C. The seal 268 is located within the conduits 270, and serves to retain the static pressure within the vessel 202C by preventing escape of gas into the region of the generator 266. The seal 268 is structured in the form of a diaphragm or a disc similar to that of the disc 210, but on a smaller scale. The gas generator 266 is excited by an electrical signal provided by an excitation circuit, such as the aforementioned circuit 18, which is to be connected by a connector 272 to the generator 266.

In operation, upon excitation of the generator 266, gas is produced under pressure to rupture the seal 268, the gas flowing via the conduit 270 into the space between the two discs 210A and 260. The pressurized gas from the generator 266 fractures the disc 210A at the interface with the edge of the slot 230, the compressed gas thereafter driving the disc 210A down to the end wall 250A. The end wall 250A has a concave surface facing the disc 210A for receiving the disc 210A upon the activation of the generator 266.

The disc 260 has a relatively lightweight construction, as compared to the disc 210A, so as to readily fracture upon a loss of equalization of the hydrostatic pressure on both sides of the disc 260. Such loss of equalization occurs upon the displacement of the disc 210A toward the end wall 250A. By way of example, a typical value of pressure in the gas produced by the generator 266 is 1000 psi. Here too, it is observed that the domed construction of the inner lightweight disc 260, in cooperation with the internal pressure of the vessel 202C, tends to resist the pressure of the gas generator 266 so as to facilitate the detachment of the outer disc 210A from the base of the neck 206C.

The force exerted by the gas from the generator 266 is produced outside of the vessel 202C, and, thereby, does not press against the powder in the direction of the discharge velocity, thereby avoiding a possible clumping of the powder during discharge.

Figure 8:
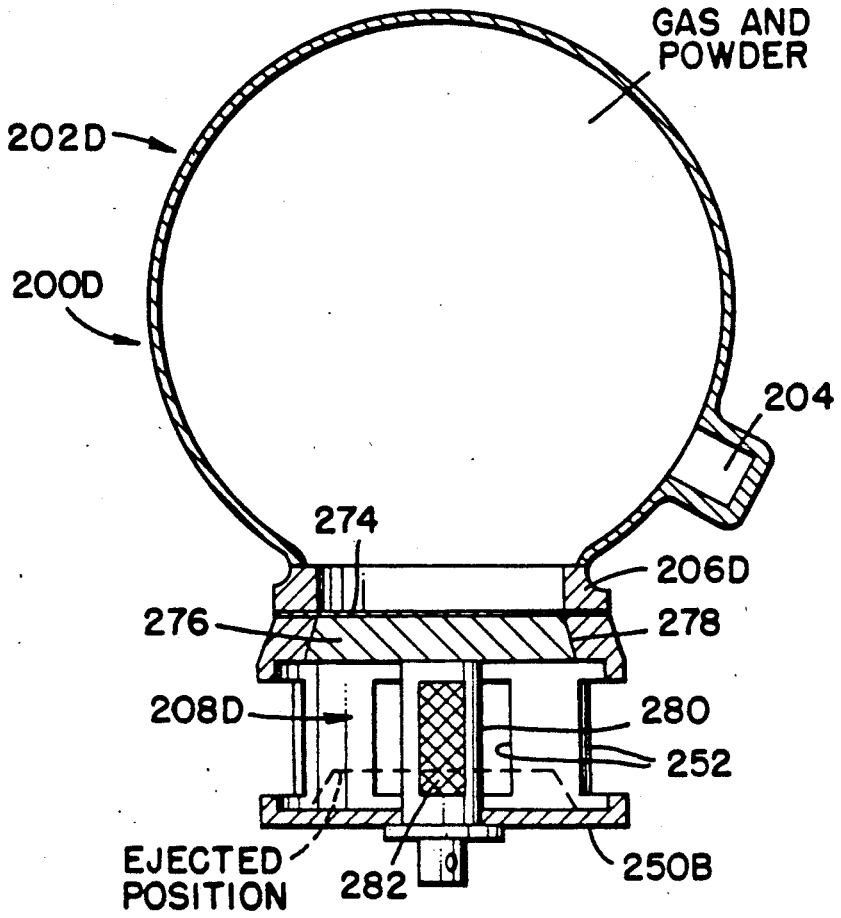
FIG. 8 shows still another embodiment of the fire extinguisher in which a disc-shaped cover of the exit port is supported by a frangible pedestal which is detonated to allow exit of the powder.

FIG. 8 discloses an embodiment of fire extinguisher 200D having a vessel 202D extending into a neck 206D forming a discharge port 208D. The neck 206D is provided with windows 252 and an end wall 250B which directs discharging powder in a circular pattern about a central axis of the extinguisher 202D. The discharge port 208D is closed off by a foil membrane 274 held by a support 276 to provide a pressure-tight seal which prevents egress of the gas and powder contained within the vessel 202D. A mating surface between the outer peripheral edge of the support 276 and the inner surface of a base portion of the neck 206D is flared outward at 278 to facilitate a displacement of the support 276 towards the end wall 250B upon discharge of powder from the vessel 202D.

The support 276 is held in position against the force of the pressurized gas within the vessel 202D by a frangible post 280 which rests upon the end wall 250B. The post 280 is hollow, and encloses a detonating compound 282 which is electrically activated by a signal from an activating circuit, such as the aforementioned circuit 18. Upon application of the electric signal to the detonating compound 282, the compound detonates with a destruction of the post 280 with a resultant release of the support 276. The support 276 is then forced away from the vessel 202D towards the end wall 250B by the pressure of the gas within the vessel 202D. The gas pressure also tears the membrane 274 immediately upon loss of the supporting force of the support 276. Thereupon, the powder discharges through the port 208D and exits in a circular pattern through the windows 252. Here too, the construction of the fire extinguisher 200D prevents the force of detonation from clumping powder during discharge from the vessel 202D.

Figure 9A:
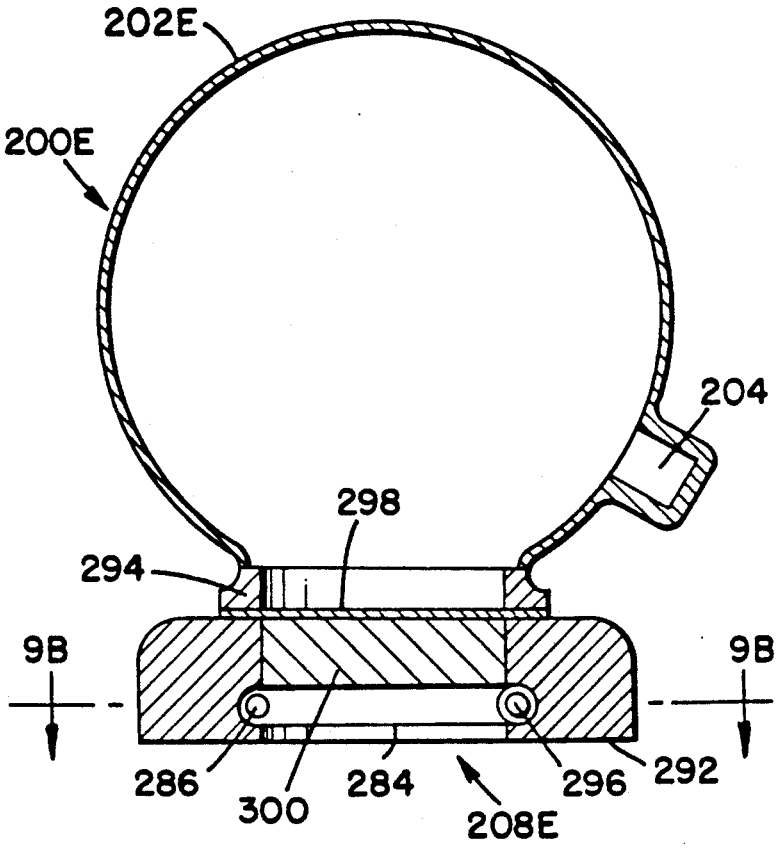
FIG. 9A is a further embodiment of the invention in which a swingable door secures a closure membrane against internal pressure of a container of powder.
Figure 9B:
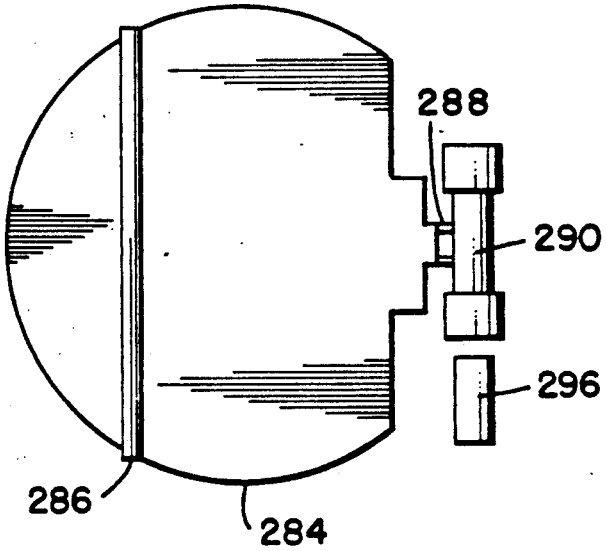
FIG. 9B is a sectional view taken along the line 9B—9B in FIG. 9A showing a protractor and release mechanism for allowing the door to swing open for release of the powder.

In FIG. 9A a fire extinguisher 200E is provided with a discharge port 208E which is closed by a trap door 284 which swings about a pivot 286, and secured by a tab 288, shown in FIG. 9B, the tab 288 being held by a pin 290. Both the pivot 286 and the pin 290 are secured within a supporting ring 292 mounted to a neck 294 of a vessel 202E which contains extinguishant powder and pressurized gas of the extinguisher 200E. The ring 292 also supports a protractor 296 which connects with the pin 290, and upon electrical activation of the protractor 296, expels the pin 290 from its position so as to release the pin 290 allowing the door 284 to swing open.

A foil membrane 298 is supported by a plug 300 so as to provide a pressure-tight seal for the contents of the vessel 202E. The plug 300 is slideably mounted within the ring 292, and is held in position by the door 284. Upon release of the door by the firing of the protractor 296, the plug 300 is expelled from the vessel 202E by the force of the contained pressurized gas, the force of the gas also tearing the membrane 298 to open the discharge port 208E. Here too, the contents of the vessel 202E are mechanically isolated from an explosion of the protractor 296 so as to prevent any clumping of the extinguishant powder during a discharge of the powder. During the discharge, the powder exits in a direction parallel to the central axis of the extinguisher 200E.

Figure 10:
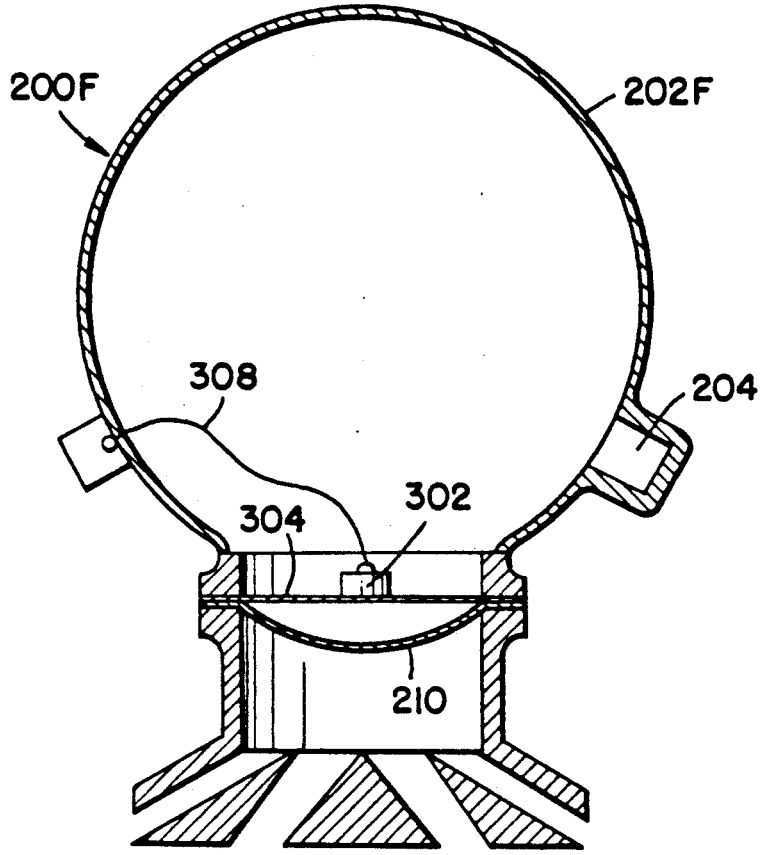
FIG. 10 shows an embodiment of the invention in which a detonator employing a shaped charge is located within the container on a closure membrane in the exit port, there being an electric wire connected to a side connector for activation of the detonator.

FIG. 10 shows a fire extinguisher 200F which is similar to that disclosed in FIG. 4A , except that the disc 210, in FIG. 10, is fractured by use of a shaped-charge detonator 302 supported by a frangible support 304, such as a plastic screen. The detonator 302 is electrically activated by an external activation circuit, such as the circuit 18, with the activating electric signal being applied via connector 306 mounted to the exterior of a vessel 202F, which vessels contains extinguishant powder and gas under pressure for the extinguishant 200F. Connection between the connector 306 and the detonator 302 is made by means of wires 308 which pass within the vessel 202F. Hot gases emitted by the detonator 302, upon detonation, burn through the disc 210, thereby destroying the disc 210 and allowing the contents of the vessel 202F to be discharged. Because of the shaped charge, the blast of the detonator 302 is exerted primarily towards the disc 210, and away from the center of the vessel 202F. The blast is completed before discharge of the contents of the vessel 202F so as to prevent clumping of the powder during discharge. The force of the discharge breaks the support 304 and expels the shattered support 304 during the discharge, so that the support 304 does not interfere with the discharge of the powder.

Figure 11:
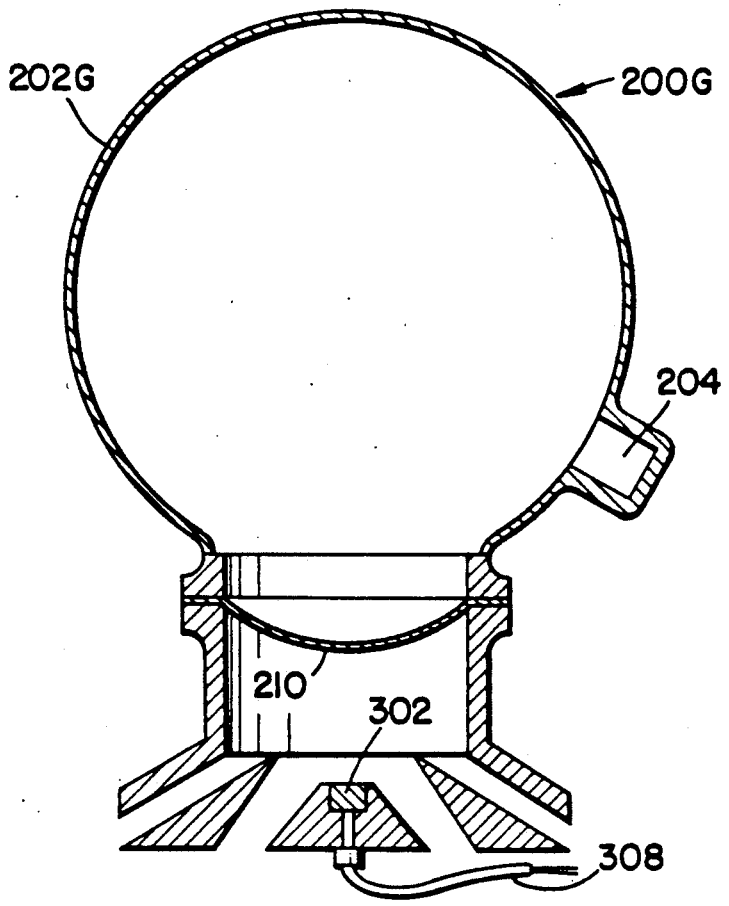
FIG. 11 is yet a further embodiment of the fire extinguisher wherein a detonator employing a shaped charge aimed at the external side of a closure disc of the powder container.

In FIG. 11, a fire extinguisher 200G is a modification of the fire extinguisher 200F of FIG. 10 in that the detonator 302 is mounted, in FIG. 11, exteriorly to the disc 210, and is excited electrically via wires 308 as is the case in FIG. 10. The shaped charge of the detonator 302 is directed towards the disc 210 for destroying the disc upon detonation of the detonator 302. This permits the contents of a vessel 202G of the extinguisher 200G to be discharged. Here too, the force of the detonation is directed in a direction other than the direction of powder velocity during the discharge, so as to avoid clumping of the powder.

Figure 12:
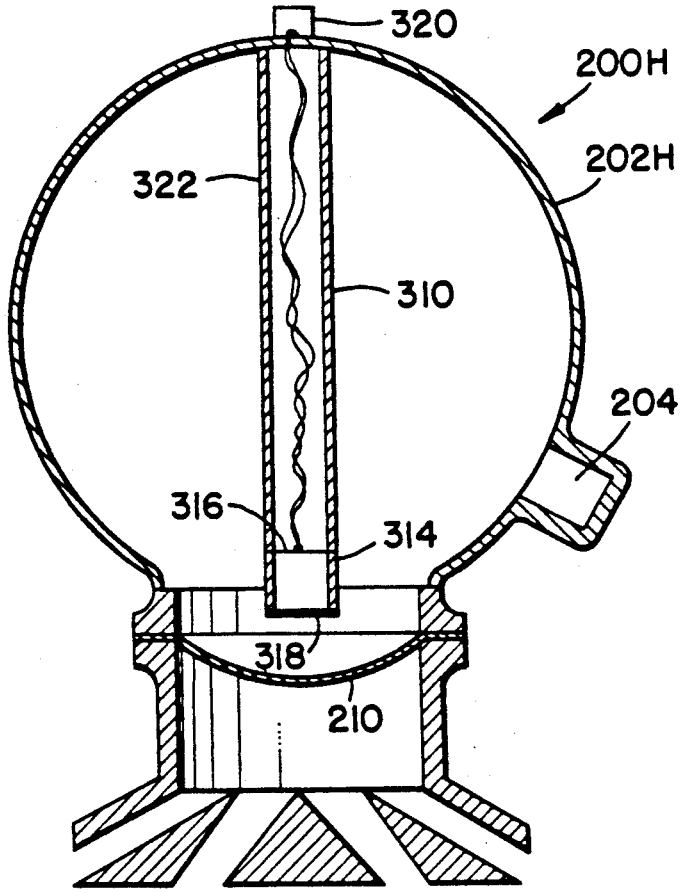
FIG. 12 is an embodiment, similar to that of FIG. 10 wherein a detonator is mounted within the end of a tube passing through the container and enclosing electric wires for activation of the detonator.
Figure 13:
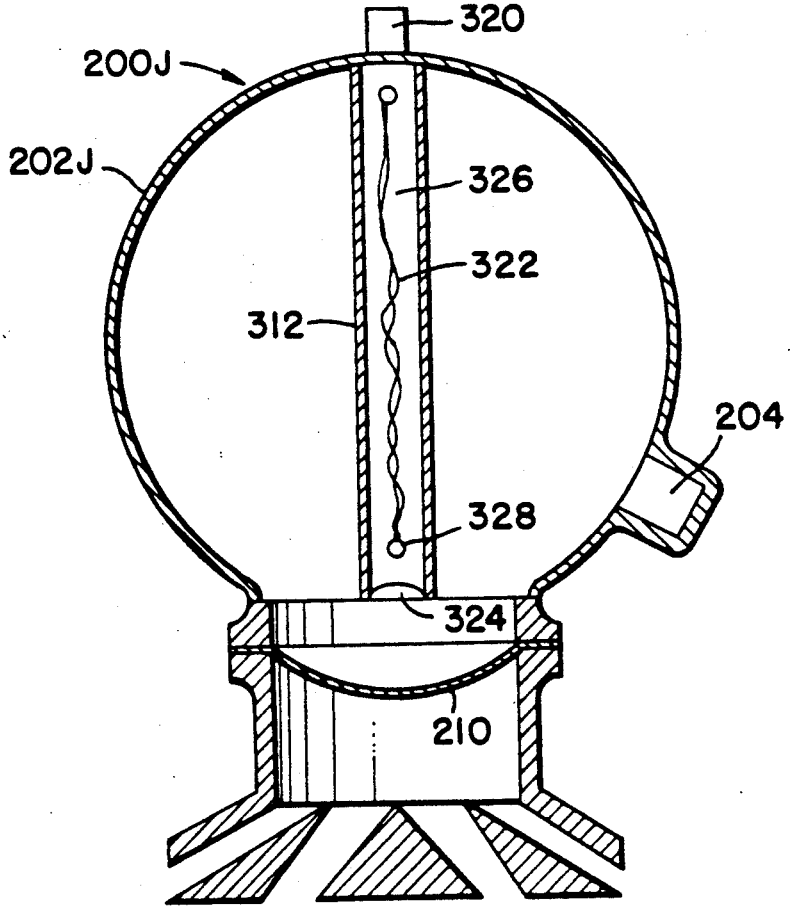
FIG. 13 shows a modification of the embodiment of FIG. 12 wherein a gas generator is employed within the central tube in lieu of the detonator.

In FIG. 12 and 13, fire extinguishers 200H and 200J are variations of the extinguishers shown respectively in FIGS. 10 and 11. The embodiments of FIGS. 12 and 13 each contain a cylindrical chamber 310, 312, respectively, containing an electrically activatable explosive device for fracturing a disc 210 in lieu of the detonators 302 of FIGS. 10 and 11. The chambers 310 and 312 are mounted along central axes of their respective vessel s 202H and 202J which contain extinguishant powder and pressurized gas.

In FIG. 12, the bottom end of the chamber 310 holds a cap 314 which, in turn, contains a detonator 316. A seal 318 is located on the exterior surface of the cap 314 and is secured to the walls of the chamber 310 to prevent egress of pressurized gas from the vessel 202H into the chamber 310. Electrical activation of the detonator 316 is accomplished via signals applied via a connector 320 located on top of the vessel 202H and electric wires 322 passing within the chamber 310 and connecting the connector 320 to the detonator 316.

In FIG. 13, the chamber 312 is closed off at its lower end by a foil seal 324 which prevents egress of pressurized gas from the vessel 202J into the chamber 312. The chamber 312 contains gas generating compounds 326 which are activated by an electrical igniter 328 in response to signals coupled thereto by wires 322 and connector 320.

In both the embodiments of FIGS. 12 and 13, explosive forces generated within the chambers 310 and 312, respectively, are directed towards the disc 210 to fracture the disc and allow discharge of the contents of the vessels 202H and 202J, respectively. In the case of the gas generation within the chamber 312 of FIG. 13, the explosion occurs at a slower rate than the explosion associated with the detonation in the chamber 310 of FIG. 12. As a result, the embodiment of FIG. 13 is less likely to produce shrapnel upon the destruction of the disc 210.

Both the embodiments of FIGS. 12 and 13 provide conveniences in manufacture. Upon completion of the physical structure of the extinguisher 200H or 200J, the extinguisher is filled with the extinguishant powder, then the vessel 202H or 202J is sealed with the disc 210. The vanes may then be assembled with the bottom portion of the neck, this being followed by pressurization of the vessel to approximately 450 psi. The manufacture is then completed by inserting either the detonator 316 in the chamber of 310, or the gas-generation compounds 326 in the chamber 312. It is noted that these chambers are constructed in the form of a well for receipt of the explosive materials at any time of convenience during the manufacturing procedure.

With respect to the various embodiments of the invention, it is noted that the embodiment of FIGS. 1 and 2 does provide a significant advantage in resistance to clumping of extinguishant powder than was available in similarly constructed fire extinguishers of the prior art. As has been noted above, this advantage is provided by the storing of the powder in a pressurized gas environment within the pressure containment vessel. The static pressure within the vessel is sufficient such that only a relatively small fractional increase of pressure is required to open the discharge port. As noted above, such fractional increase in the pressure may introduce some clumping of the powder, which clumping is substantially less than is found in similarly constructed fire extinguishers of the prior art.

The further embodiments of FIGS. 4–13 produce still further advantages over the embodiment of FIGS. 1–2 as may be appreciated from the following discussion.

In the case of a fire extinguisher constructed in a fashion wherein the combustion gas of a detonator or a gas generator mingles with the powder and compressed gas stored in the containment vessel, the powder extinguishant cool s the combustion gas. This necessitates a considerable increase of propellant charge to achieve the required discharge pressure. In a typical situation, by way of example, 6 grams of black powder to 80 grams of extinguishant are employed to provide 360 psi burst pressure. This results in an increase of burning time such that several milliseconds may be required before the burning produces the requisite discharge pressure. Any additional use of propellant would make the weight of the propellant to be a an appreciable percentage of the extinguishant weight.

In the embodiments of FIGS. 4–13, the physical configuration of the containment vessel and the apparatus which opens the vessel, such as a detonator shaped charge, a knife assembly, a trap door assembly, or dual disc assembly, provides for adequate separation of the combustion gas and the fire extinguishant materials of the containment vessel to avoid the foregoing cooling phenomenon of the extinguishant powder. Also, as has been noted hereinabove, the emplacement of the site of the detonation in the vicinity of the discharge port, rather than within the containment vessel, as well as the complete separation of the detonation from the containment vessel, prevents the relatively small clumping associated with the discharge overpressure in the embodiment of FIGS. 1-2.

Other advantages are as follows. The extinguisher design avoids excessive weight. The powder is ejected from a relatively small diameter which permits a secure closure to protect personnel and equipment from accidental damage during a fall.

The design of the fire extinguisher provides for a rapid and even dispersion of the extinguishant because the gas-powder mixture has fluid flow properties. Initially, extinguishant is projected with maximum velocity and is carried rapidly to the limits of a compartment (such as a compartment on board an aircraft) which is protected by the extinguisher. The gas pressure decays progressively as the extinguisher empties, this ensuring that an even dispersion is achieved. The small orifice at the discharge port permits the use of relatively small sized deflection vanes to induce a predetermined discharge pattern optimized for a particular configuration of compartment which is to be protected. Discharge of the extinguishant materials is initiated within only a fraction of a millisecond.

Also, the fire extinguisher may be mounted in any desired attitude. The discharge time of the fire extinguisher is established by the configuration of the discharge port relative to the overall volume of the containment vessel. A narrowing of the discharge port increases the discharge time, while a widening of the discharge port reduces the discharge time. The mass flow rate is very high as compared to extinguishers of the prior art.

Various gases may be employed as the compressed gas within the containment vessel. An inert gas is fire suppressant. Helium is a convenient gas to use because it is readily detected by a mass spectrometer to assess hermetic sealing of the extinguisher.

The configuration of the extinguisher permits the cover of the discharge port, such as the domed disc or foil membrane supported by a rigid plug, to be secured adequately to the neck of the vessel for retaining gas pressure over an extended period of time, such as ten years. For long retention time, the wall of the containment vessel and the construction of the discharge port should be sufficiently rigid to resist any tendency to creep under the influence of the long term pressure.

It is to be understood that the above described embodiment of the invention is illustrative only, and that modifications thereof may occur to those skilled in the art. Accordingly, this invention is not to be regarded as limited to the embodiment disclosed herein, but is to be limited only as defined by the appended claims.

What is claimed is:

1. A self-contained fire extinguisher comprising:

a container for storing fire-suppressant powder and a fluidic propellant under pressure, said container having a port for release of the fire suppressant powder;

means located at said port and outside of said container for opening said port to allow for escape of said powder and said propellant in a homogeneous discharge free of a clumping of the powder;

radiation sensors including a heat detector and a light detector mounted on said container;

battery operated electrical circuitry mounted on said container and responsive to signals of said radiation sensors for activating said opening means, said electrical circuitry including a filter having a pass band set to pass spectral components of pulsations in thermal radiation for enabling said electrical circuitry to respond to the presence of a fire; and wherein said electrical circuitry comprises a low-noise, low-current, differential amplifier coupled to said heat detector, and an operational amplifier connecting said differential amplifier to said filter, currents drawn by said differential amplifier and by said operational amplifier and by said detectors being sufficiently low to permit use of a battery by said electrical circuit for a period of time in excess of one year.

2. A fire extinguisher according to claim 1 further comprising a battery for powering the electrical circuitry, and wherein said operational amplifier has two input terminals, and said differential amplifier comprises a first transistor having a first collector terminal, a first base terminal and a first emitter terminal;

a second transistor having a second collector terminal, a second base terminal and a second emitter terminal, the emitter terminals of said transistors being connected to each other at an emitter junction;

an emitter resistor connecting said emitter junction to a first terminal of said battery, said first base terminal being connected to said heat detector;

a first load resistor connecting said first collector terminal to a second terminal of said battery, a second load resistor connecting said second collector terminal to the second terminal of said battery, a first coupling resistor connecting said first collector terminal to a first of the input terminals of said operational amplifier, a second coupling resistor connecting said second collector terminal to a second of the input terminals of said operational amplifier; and wherein said electrical circuitry includes a feedback path interconnecting an output terminal of said operational amplifier with said second base terminal.

3. A fire extinguisher according to claim 2 wherein said battery provides a voltage having a typical value of 2.4 volts between said battery terminals;

each of said load resistors has a typical resistance of 120,000 ohms, each of said coupling resistors has a typical resistance of 200,000 ohms, and said emitter resistor has a typical resistance of 80,000 ohms; and said first and said second transistors together draw typically ten microamperes from said battery.

4. A fire extinguisher according to claim 3 wherein said heat detector is a thermopile, the fire extinguisher further comprising a first base resistor interconnecting said first base terminal with said thermopile; and wherein said feedback path comprises a second base resistor interconnecting said second base terminal with said output terminal of said operational amplifier, and a third resistor interconnecting said second base terminal with said first battery terminal, said operational amplifier drawing typically ten microamperes from said battery.

5. A fire extinguisher according to claim 1 wherein said operational amplifier has two input terminals, and said differential amplifier comprises a first transistor having a first collector terminal, a first base terminal and a first emitter terminal;

a second transistor having a second collector terminal, a second base terminal and a second emitter terminal, the emitter terminals of said transistors being connected to each other at an emitter junction;

an emitter resistor connecting said emitter junction to a first terminal for said battery, said first base terminal being connected to said heat detector;

a first load resistor connecting said first collector terminal to a second terminal of said battery, a second load resistor connecting said second collector terminal to the second terminal of said battery, a first coupling resistor connecting said first collector terminal to a first of the input terminals of said operational amplifier, a second coupling resistor connecting said second collector terminal to a second of the input terminals of said operational amplifier; and wherein said electrical circuitry includes a first base resistor interconnecting said first base terminal with said heat detector; and a feedback path interconnecting an output terminal of said operational amplifier with said second base terminal, said feedback path comprising a second base resistor interconnecting said second base terminal with said output terminal of said operational amplifier, and a third resistor interconnecting said second base terminal with said first battery terminal.

6. A self-contained fire extinguisher comprising:

a container for storing fire-suppressant powder and a fluidic propellant under pressure, said container having a port for release of the fire suppressant powder;

means located at said port and outside of said container for opening said port to allow for escape of said powder and said propellant in a homogeneous discharge free of a clumping of the powder;

radiation sensors including a heat detector and a light detector mounted on said container;

battery operated electrical circuitry mounted on said container and responsive to signals of said radiation sensors for activating said opening means, said electrical circuitry including a filter having a pass band set to pass spectral components of pulsations in thermal radiation for enabling said electrical circuitry to respond to the presence of a fire; and wherein said electrical circuitry comprises a battery for powering said electrical circuitry, a low-noise, low-current, differential amplifier coupled to said heat detector, and an operational amplifier connecting said differential amplifier to said filter; and said electrical circuitry further comprises resistive interconnections between said differential amplifier and said operational amplifier and said battery for reducing currents drawn by said differential amplifier and by said operational amplifier each to typically ten microamperes to permit use of said battery by said electrical circuit for a period of time in excess of three years.

* * * * *